United States Patent [19]

Daller

[11] 4,030,761

[45] June 21, 1977

[54] DART

[76] Inventor: Hans Daller, c/o H. Daller Realty Ltd., 3256 Eglinton Ave. East, Scarborough, Ont., Canada, M1J 2H6

[22] Filed: Sept. 8, 1976

[21] Appl. No.: 721,336

[52] U.S. Cl. ..... 273/106.5 A; 46/178; 273/106.5 R; 273/106.5 C

[51] Int. Cl.[2] ..... A63B 65/02

[58] Field of Search ..... 273/106.5, 106 F; 46/52, 74–81, 174, 178, 180, 181

[56] References Cited

UNITED STATES PATENTS

| | | | |
|---|---|---|---|
| 1,328,967 | 1/1920 | Reaben | 273/106.5 R |
| 1,918,718 | 7/1933 | Samsel | 273/106.5 A |
| 2,620,190 | 12/1952 | Bean | 273/106.5 R |
| 2,836,930 | 6/1958 | Ragazzo et al. | 46/52 X |
| 2,838,871 | 6/1958 | Boring | 46/52 |
| 2,940,759 | 6/1960 | West | 273/106 F X |
| 3,834,368 | 9/1974 | Geiger | 273/106.5 C X |
| 3,918,427 | 11/1975 | Turner | 273/106.5 B X |
| 3,976,298 | 8/1976 | Hinchman | 273/106.5 R |

FOREIGN PATENTS OR APPLICATIONS

| | | | |
|---|---|---|---|
| 10,033 | 4/1909 | France | 273/106.5 A |

*Primary Examiner*—Paul E. Shapiro
*Attorney, Agent, or Firm*—Robert D. Farkas

[57] ABSTRACT

This disclosure pertains to a dart, having a suction cup at one end thereof and a stabilizing fin additionally serving as a handle at the other end. A cavity, affixed to the proximal end of the suction cup contains a ball and communicates to a hollow flexible tubing, utilized as a shaft, interconnecting the wing end and the suction cup end of the apparatus. A plurality of holes pass through the walls at the proximal end of the cavity and communicate air, by way of the flexible tubing, to a whistling apparatus, disposed at the proximal end of the tubing. The ball creates a tamping force which insures a better grasp between the suction cup and the target surface against which it is propelled. When the ball is disposed within the cavity at a location adjacent the proximal end thereof, the holes are sealed effectively silencing the whistling apparatus.

6 Claims, 3 Drawing Figures

DART

BACKGROUND OF THE INVENTION

1. The Field of the Invention

This invention relates to darts and more particularly to that class utilizing suction cup grasping devices and capable of producing sounds in flight.

2. Description of the Prior Art

The prior art abounds with darts in a wide variety of constructions. U.S. Pat. No. 1,918,718 issued on July 18, 1933 to N. E. Samsel teaches a dart equipped with a suction cup and having a cavity adjacent thereto housing a ball therein, so as to insure grasping of the dart apparatus to the surface of the target. The proximal end of the apparatus is adapted with a plurality of stabilizing fins.

U.S. Pat. No. 2,838,871 issued on June 17, 1958 to F. M. Boring discloses a pointed dart having stabilizing fins at the other end thereof. A vane is rotated by the force of the air travelling through operating ports, so as to create a whistling sound throughout the total period of time that the dart is in motion.

The aforementioned patents suffer the common deficiency of failing to provide a dart which is capable of producing sounds during selective portions of its flight, whilst insuring that the suction cup apparatus, affixed at one end, will firmly grasp the target. Furthermore, the prior art does not teach a dart apparatus which may be rolled up or folded up in a convenient storage position when the dart is not in use.

SUMMARY OF THE INVENTION

A primary object of the present invention is to provide a dart which produces a whistling sound during selective portions of its flight through the air.

Another object of the present invention is to provide a dart which may be folded, or rolled up, when not in use.

Still another object of the present invention is to provide a dart which utilizes a suction cup to securely grasp the target against which it is manually propelled.

Yet another object of the present invention is to provide stabilizing fins having a handle grasping portion built thereinto.

Heretofore, whistling darts produced a sound throughout the duration of the flight of the dart, having an intensity and a pitch proportioned to the speed of travel. The present invention by selectively closing off air intake ports, creates sounds during those portions of the flight in which the dart is descending to the earth and during those periods of time, in near level flight, when the dart approaches a target surface as opposed to when the dart leaves the hand of the user throwing the dart, at which time the ports are closed. The apparatus utilized to securely affix the suction cup end of the dart to the target in the form of a ball, selectively closes the air intake vents which provide operating air to the whistling apparatus housed within the dart.

These objects, as well as other objects of the present invention, will become more readily apparent after reading the following description of the accompanying drawings.

DESCRIPTION OF THE PREFERRED EMBODIMENT

Figure 1:
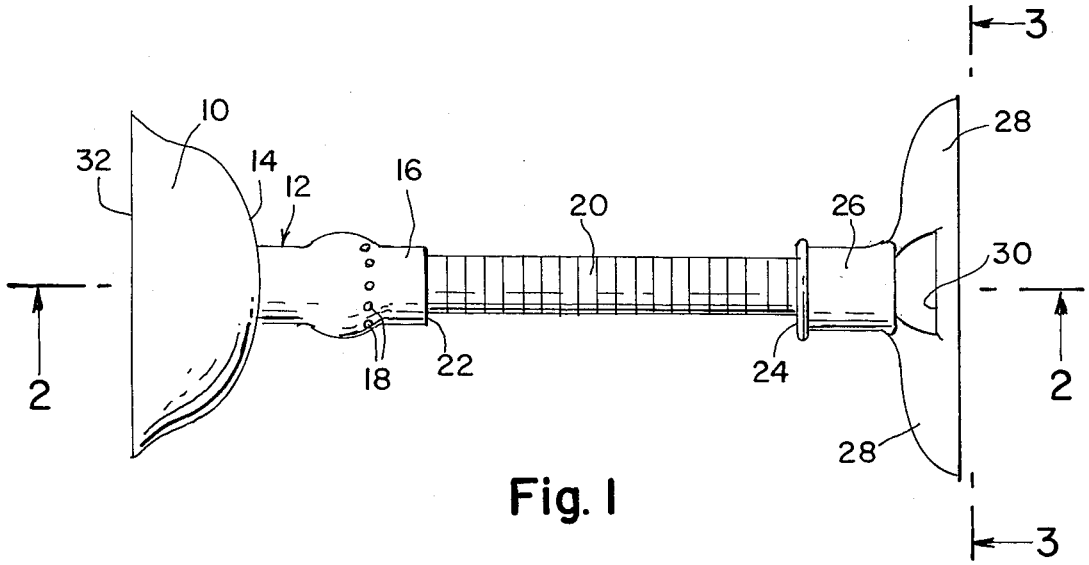
FIG. 1 is a side elevation view of the present invention.

The structure and method of fabrication of the present invention is applicable to a suction cup, fabricated from a rubber-like material and having a hollow conical protrusion affixed to the convex exterior surface thereof. The protrusion is adapted with an open mouth portion at the free end thereof. Intermediate the open mouth portion and the point of attachment of the protrusion to the convex exterior surface of the suction cup, a bulbous circular excursion occurs in the interior and exterior surfaces of the protrusion extending radially outwardly. A hard rubber-like ball is located within the bulbous excursion, being free to move there-within. A plurality of holes pass through the walls of the bulbous excursion and are disposed in spaced apart relationship about the circumference of the excursion, located intermediate the widest part of the excursion and the open mouth portion of the protrusion. The ball, when displaced closest to the open mouth portion, closes the holes, so as to prevent the entrance of air from outside the interior of the protrusion to the spherical cavity formed there-within.

A flexible rubber-like tubing is fitted at one end thereof to the open mouth portion of the protrusion. The other end of the flexible hollow tubing fits within a tail assembly and is secured thereto. The interior passageway of the hollow tubing communicates with a whistling sound generating apparatus affixed within the tail assembly, which in turn is vented to the atmosphere through a suitable opening therein. The tail assembly includes a pair of outwardly disposed wings lying in a common plane, and having a cut-out portion there-in-between, suitable for use as a carrying or throwing handle. When the dart is propelled in a near horizontal path, the ball moves towards the proximal end of the apparatus due to the forces of inertia. At this time, the ball seals the air inlet holes, preventing the entrance of air there-through causing the whistle sound generating apparatus to remain silent. When the forces of inertia have been satisfactorily overcome, the ball unseats from its hole closure position, allowing air to enter inlet holes thereby generating a whistling sound. Upon impact with the target surface, the ball is further propelled in the direction of travel of the dart apparatus due to the forces of momentum, causing the suction cup mouth to securely grasp the target's surface. When the dart is propelled in an upward direction from the earth, the ball closes the air inlet ports, causing the dart to remain silent. After the dart has achieved it's apogee and the dart is descending, the ball opens the air inlet holes causing a pleasing whistling sound, similar to the shrill sound emitted by falling bombs, of ever increasing intensity climaxed by contact with the surface of the earth.

The flexible tubing, due to its rubber-like characteristics, permits the dart apparatus to be rolled up or folded, when not in use. The handle grasping portion of the tail piece assembly may be utilized to carry the dart, when not in use, or to propel the dart.

The flexible tubing, connecting the front suction cup portion and the rear section portion including the handle, wings and the whistle, should not be permanently attached to each other. For indoor activity, the suction cup section and the handle-wing-whistle section may be connected by way of couplings directly, without the elastic long rubber tube portion in between. Said couplings being the open end portion of the suction cup section and the handle-wing-whistle section, interlocking the two parts together forming a sealed airtight joint. For outdoor activity, the soft rubber-like tube may overlap the opening in the suction cup section as well as overlapping the opening in the handle-wing-whistle section, i.e. the rubber-like tube fabricated to snap outside and over these hard sections rather than to slide inside. For quick separation and assembly a very light but durable spring ring may be employed to hold the rubber-like hose at each end over the hard rubber-like end sections.

Now referring to the figures, and more particularly to the embodiment illustrated in FIG. 1 showing a suction cup 10 having protrusion 12 extending from the outermost convex surface 14 thereof. Protrusion 12 has a circular excursion 16 disposed along the length thereof. Holes 18 communicate to the hollow interior, not shown of protrusion 12. Flexible rubber-like like tubing 20 is attached to the free end 22 of protrusion 12 and to one free end 24 of tail assembly 26. Fins 28 are fixed to the tail assembly 26 and are adapted with a handle-like opening 30 there-in-between.

Figure 2:
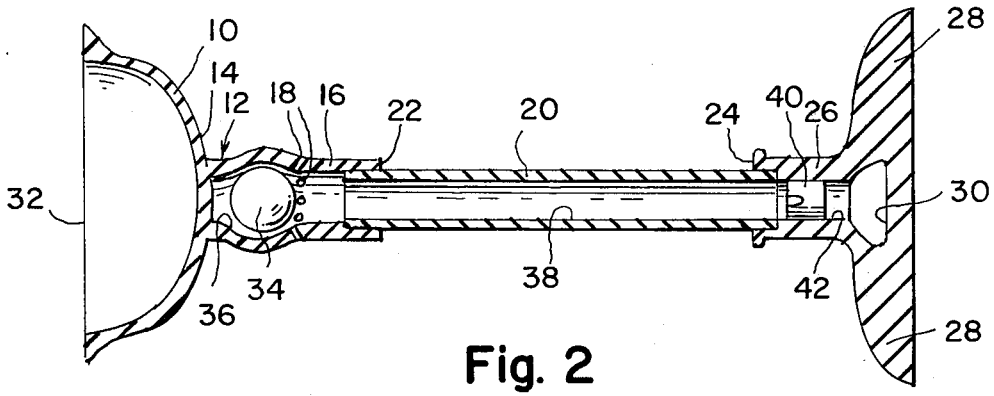
FIG. 2 is a cross-sectional view of the present invention as illustrated in FIG. 1.

FIG. 2 illustrates the mouth portion 32 of suction cup 10 and the exterior convex surface 14 thereof. Ball 34 is disposed within an outwardly extending interior surface excursion 36 disposed within protrusion 12. Ball 34, when located in its furthestmost portion from suction cup 10, eloses holes 18. Holes 18, when opened, communicates air passing by the outermost surface of protrusion 12 through the interior passageway 38 of flexible tubing 20. Whistle assembly 40 is fluidly connected to passageway 38 and an air exit port 42, permitting the assembly to create a whistling sound when ball 34 is disposed uncovering holes 18. Flexible tubing 20, due to its resilient characteristics, enables tail assembly 26 to be manually disposed adjacent suction cup 10 when flexible tubing 20 is folded, so as to shorten the length of the dart when not in use.

Figure 3:
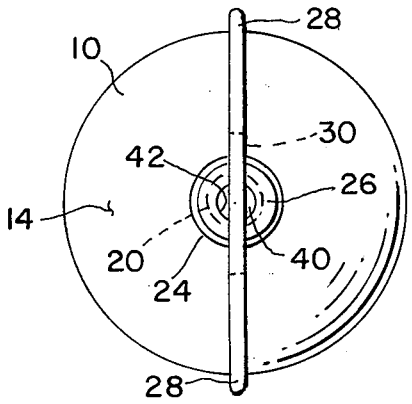
FIG. 3 is a rear elevation view taken along line 3—3 viewed in the direction of arrows 3—3 as shown in FIG. 1.

FIG. 3 illustrates wings 28 disposed in a common plane and having handle opening 30 centrally disposed there-in-between. Opening 42 communicates from the interior of flexible tubing 20 through the whistle apparatus 40, shown in FIG. 2.

One of the advantages of the present invention is a dart which produces a whistling sound during selective portions of its flight through the air.

Another advantage of the present invention is a dart which may be folded, or rolled up, when not in use.

Still another advantage of the present invention is a dart which utilizes a suction cup to securely grasp the target against which it is manually propelled.

Yet another advantage of the present invention is a dart with stabilizing fins having a handle grasping portion built there-into.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims. I claim:

1. A dart comprising a suction cup, a protrusion fixedly secured to the convex exterior surface of said suction cup, said protrusion including a cavity and an open mouth portion, said open mouth portion disposed at the free end of said protrusion and communicating to said cavity, a spherical bulgelike excursion in the walls of said protrusion, said excursion extending radially outwardly from said cavity, a plurality of holes being disposed in spaced apart relationship about the circumference of said excursion intermediate the widest portion thereof and said open mouth portion of said protrusion, means to selectively vent said cavity to the atmosphere when said suction cup is disposed in a lower position than said open mouth portion, a whistle sound generating apparatus, means to fluidly communicate said open mouth portion to said whistle sound generating apparatus, a plurality of stabilizing fins affixed to the proximal end of said dart.

2. The dart as claim 1 further comprising a tail assembly, said tail assembly including said plurality of stabilizing fins and handle-like opening centrally disposed intermediate said plurality of stabilizing fins, an air venting opening communicating air leaving said whistle sound generating apparatus to said atmosphere.

3. The dart as claimed in claim 2 wherein said communicating means comprises a flexible rubber-like tubing, one end of said flexible rubber-like tubing fixedly secured to said open mouth portion, a housing, said whistle sound generating apparatus contained within said housing, the other end of said flexible rubber-like tubing fluidly communicating to the interior of said housing and to the input port of said whistle sound generating apparatus.

4. The dart as claimed in claim 3 wherein said plurality of stabilizing fins comprise a pair of fins, said pair of fins being disposed lying in a plane, said flexible rubber-like tubing having a longitudinal axis, said longitudinal axis lying in said plane, said pair of fins extending radially outwardly from said longitudinal axis, said handle-like being disposed in said plane, said longitudinal axis passing through the center of said handle-like opening.

5. The dart as claimed in claim 1 wherein said venting means comprises a ball, said ball being disposed within said cavity at the location of said excursion, said ball being selectively disposed sealing said plurality of holes.

6. The dart as claimed in claim 1 wherein said suction cup and said protrusion is comprised of a flexible rubber-like material.

* * * * *